US009207599B2

(12) United States Patent
Hayase et al.

(10) Patent No.: US 9,207,599 B2
(45) Date of Patent: Dec. 8, 2015

(54) FIXING DEVICE

(71) Applicant: Konica Minolta, Inc., Chiyoda-ku, Tokyo (JP)

(72) Inventors: Toru Hayase, Toyohashi (JP); Mamoru Fukaya, Nagoya (JP); Naoki Kataoka, Toyokawa (JP); Tsuyoshi Tamaru, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/663,982

(22) Filed: Mar. 20, 2015

(65) Prior Publication Data

US 2015/0268606 A1 Sep. 24, 2015

(30) Foreign Application Priority Data

Mar. 20, 2014 (JP) ..... 2014-057580

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2078
USPC ..... 399/329
See application file for complete search history.

(56) References Cited

U.S. PATENT DOCUMENTS

| | | | | |
|---|---|---|---|---|
| 5,752,148 | A * | 5/1998 | Yoneda et al. | 399/329 |
| 8,190,074 | B2 * | 5/2012 | Han | |
| 8,718,524 | B2 * | 5/2014 | Kimura | 399/329 |
| 8,923,740 | B2 * | 12/2014 | Kuroda | 399/329 |
| 2013/0064586 | A1 * | 3/2013 | Adachi et al. | 399/329 |
| 2013/0302073 | A1 | 11/2013 | Takeuchi | |
| 2015/0063882 | A1 * | 3/2015 | Nakano | 399/329 |

FOREIGN PATENT DOCUMENTS

| | | | |
|---|---|---|---|
| JP | 2011-013410 | A | 1/2011 |
| JP | 2012-103612 | A | 5/2012 |
| JP | 2013-235157 | A | 11/2013 |

* cited by examiner

*Primary Examiner* — Susan Lee
(74) *Attorney, Agent, or Firm* — Buchanan Ingersoll & Rooney PC

(57) ABSTRACT

A fixing device having: a first rotating member rotating in a first rotational direction; a second rotating member contacting the first rotating member and thereby forming a nip through which a printing medium passes, wherein the second rotating member rotates in a second rotational direction opposite to the first rotational direction; a heating unit heating the first rotating member in a heating section not overlapping with the nip when viewed in a plan view in the predetermined direction; and a first reflective member facing at least a part of a portion of the first rotating member that is located on a downstream side in the first rotational direction relative to the heating section but on an upstream side in the first rotational direction relative to the nip, the first reflective member having a reflection surface on the side facing the first rotating member.

9 Claims, 5 Drawing Sheets

FIXING DEVICE

This application is based on Japanese Patent Application No. 2014-057580 filed on Mar. 20, 2014, the content of which is incorporated herein by reference.

BACKGROUND OF THE INVENTION

1. Field of the Invention

The present invention relates to fixing devices, more particularly to a fixing device for use in an image forming apparatus.

2. Description of Related Art

As an invention relevant to a conventional fixing device, for example, a fixing device described in Japanese Patent Laid-Open Publication No. 2012-103612 is known. FIG. 5 is a configuration diagram of the fixing device 500 described in Japanese Patent Laid-Open Publication No. 2012-103612.

The fixing device 500 includes a fixing roller 502, a heating roller 504, a fixing belt 506, a halogen heater 508, a reflective member 510, and a pressure roller 512. The fixing belt 506 is stretched between the fixing roller 502 and the pressure roller 504. The halogen heater 508 is provided in the heating roller 504 in order to heat the fixing belt 506 through the heating roller 504. The reflective member 510 faces a portion of the fixing belt 506 that is in contact with the heating roller 504, so that radiation heat of the fixing belt 506 is reflected back toward the fixing belt 506. There is a nip formed by the pressure roller 512 exerting pressure upon a portion of the fixing roller 502 that is in contact with the fixing belt 506.

Incidentally, the portion of the fixing belt 506 that has been heated by the heating roller 504 is moved to the nip by the rotation of the fixing roller 502 and the heating roller 504. Then, the heated portion of the fixing belt 506 heats a printing medium passing through the nip. However, after the portion of the fixing belt 506 that has been heated by the heating roller 504 leaves the heating roller 504, the heated portion of the fixing belt 506 does not continue to be heated, and therefore, simply radiates heat until it arrives at the nip. Accordingly, during the period after leaving from the heating roller 504 until the arrival at the nip, the temperature of the fixing belt 506 decreases, resulting in heat loss.

SUMMARY OF THE INVENTION

A fixing device according to an embodiment of the present invention includes: a first rotating member rotating in a first rotational direction when viewed in a plan view in a predetermined direction; a second rotating member contacting the first rotating member and thereby forming a nip through which a printing medium passes, wherein the second rotating member rotates in a second rotational direction opposite to the first rotational direction when viewed in a plan view in the predetermined direction; a heating unit heating the first rotating member in a heating section not overlapping with the nip when viewed in a plan view in the predetermined direction; and a first reflective member facing at least a part of a portion of the first rotating member that is located on a downstream side in the first rotational direction relative to the heating section but on an upstream side in the first rotational direction relative to the nip, the first reflective member having a reflection surface on the side facing the first rotating member.

DETAILED DESCRIPTION OF THE PREFERRED EMBODIMENTS

Hereinafter, an image forming apparatus including a fixing device according to an embodiment of the present invention will be described with reference to the drawings.

Configuration of Image Forming Apparatus

Figure 1:
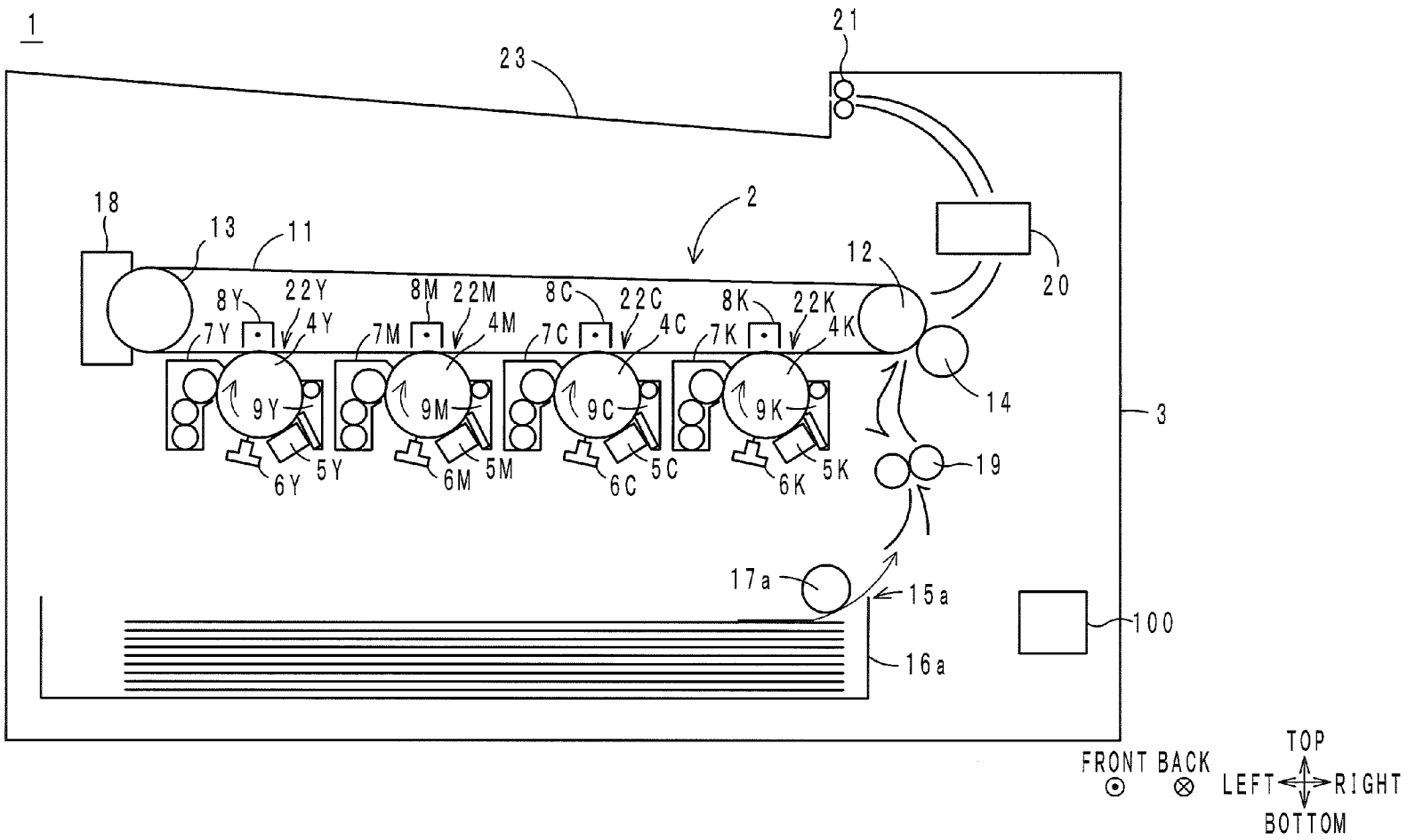
FIG. 1 is a diagram illustrating the overall configuration of an image forming apparatus 1.

The configuration of the image forming apparatus including the fixing device according to the embodiment of the present invention will be described below with reference to the drawings. FIG. 1 is a diagram illustrating the overall configuration of the image forming apparatus 1. The left-right direction of the sheet of FIG. 1 will be referred to simply as the left-right direction, the front-back direction of the sheet will be referred to simply as the front-back direction, and the top-bottom direction of the sheet will be referred to simply as the top-bottom direction.

The image forming apparatus 1 is an electrophotographic color printer of a so-called tandem type adapted to combine images in four colors (Y: yellow, M: magenta, C: cyan, and K: black). The image forming apparatus 1 has the function of forming an image on a sheet (printing medium) on the basis of image data obtained by a scanner, and includes a printing unit 2, a main body 3, a paper feed cassette 15*a*, a timing roller pair 19, the fixing device 20, an ejection roller pair 21, an output tray 23, and a control unit 100, as shown in FIG. 1.

The main body 3 is a housing for the image forming apparatus 1, and accommodates the printing unit 2, the paper feed cassette 15*a*, the timing roller pair 19, the fixing device 20, the ejection roller pair 21, and the control unit 100.

The paper feed cassette 15*a* plays the role of supplying sheets one by one, and generally includes a sheet tray 16*a* and a paper feed roller 17*a*. In the sheet tray 16*a*, a plurality of unprinted sheets are stacked and mounted. The paper feed roller 17*a* takes out the sheets mounted in the sheet tray 16*a* one by one.

The timing roller pair 19 forwards a sheet having been supplied by the paper feed cassette 15*a* while performing timing control such that the sheet is subjected to secondary transfer of toner images in the printing unit 2.

The printing unit 2 is adapted to form toner images on the sheet having been supplied by the paper feed cassette 15*a*, and includes imaging units 22Y, 22M, 22C, and 22K, optical scanning devices 6Y, 6M, 6C, and 6K, transfer units 8Y, 8M, 8C, and 8K, an intermediate transfer belt 11, a drive roller 12, a driven roller 13, a secondary transfer roller 14, and a cleaning device 18. Moreover, the imaging units 22Y, 22M, 22C, and 22K respectively include photoreceptor drums 4Y, 4M, 4C, and 4K, chargers 5Y, 5M, 5C, and 5K, developing devices 7Y, 7M, 7C, and 7K, and cleaners 9Y, 9M, 9C, and 9K.

The photoreceptor drums 4Y, 4M, 4C, and 4K are provided in the form of cylinders in the main body 3. The photoreceptor drums 4Y, 4M, 4C, and 4K are rotated clockwise in FIG. 1. The chargers 5Y, 5M, 5C, and 5K electrically charge the circumferential surfaces of the photoreceptor drums 4Y, 4M, 4C, and 4K. The optical scanning devices 6Y, 6M, 6C, and 6K under control of the control unit 100 scan beams BY, BM, BC, and BK on the circumferential surfaces of the photoreceptor drums 4Y, 4M, 4C, and 4K. As a result, electrostatic latent images are formed on the circumferential surfaces of the photoreceptor drums 4Y, 4M, 4C, and 4K.

The developing devices 7Y, 7M, 7C, and 7K are provided in the main body 3 in order to apply toner to the photoreceptor drums 4Y, 4M, 4C, and 4K and thereby develop toner images based on the electrostatic latent images.

The intermediate transfer belt 11 is stretched between the drive roller 12 and the driven roller 13. The intermediate transfer belt 11 is subjected to primary transfer of the toner images developed on the photoreceptor drums 4Y, 4M, 4C, and 4K. The transfer units 8Y, 8M, 8C, and 8K are disposed so as to face the inner circumferential surface of the intermediate transfer belt 11, and play the role of subjecting the intermediate transfer belt 11 to primary transfer of toner images formed on the photoreceptor drums 4Y, 4M, 4C, and 4K. The cleaners 9Y, 9M, 9C, and 9K collect toner remaining on the circumferential surfaces of the photoreceptor drums 4Y, 4M, 4C, and 4K after primary transfer. The drive roller 12 is caused to rotate by an intermediate transfer belt drive unit (not shown in FIG. 1), thereby driving the intermediate transfer belt 11 counterclockwise. As a result, the intermediate transfer belt 11 carries the toner images to the secondary transfer roller 14.

The secondary transfer roller 14 is in the form of a drum facing the intermediate transfer belt 11. Upon application of a voltage for transfer, the secondary transfer roller 14 subjects a sheet passing between the intermediate transfer belt 11 and the secondary transfer roller 14 to secondary transfer of the toner images carried on the intermediate transfer belt 11. After the secondary transfer of the toner images onto the sheet, the cleaning device 18 removes toner remaining on the intermediate transfer belt 11.

The sheet subjected to the secondary transfer of the toner images is transported to the fixing device 20. The fixing device 20 heats and presses the sheet, thereby fixing the toner images on the sheet.

The ejection roller pair 21 ejects the sheet transported through the fixing device 20 onto the output tray 23. In this manner, printed sheets are deposited on the output tray 23.

The control unit 100 is, for example, a CPU, and is adapted to control the operation of the image forming apparatus 1.

Configuration of Fixing Device

Figure 2:
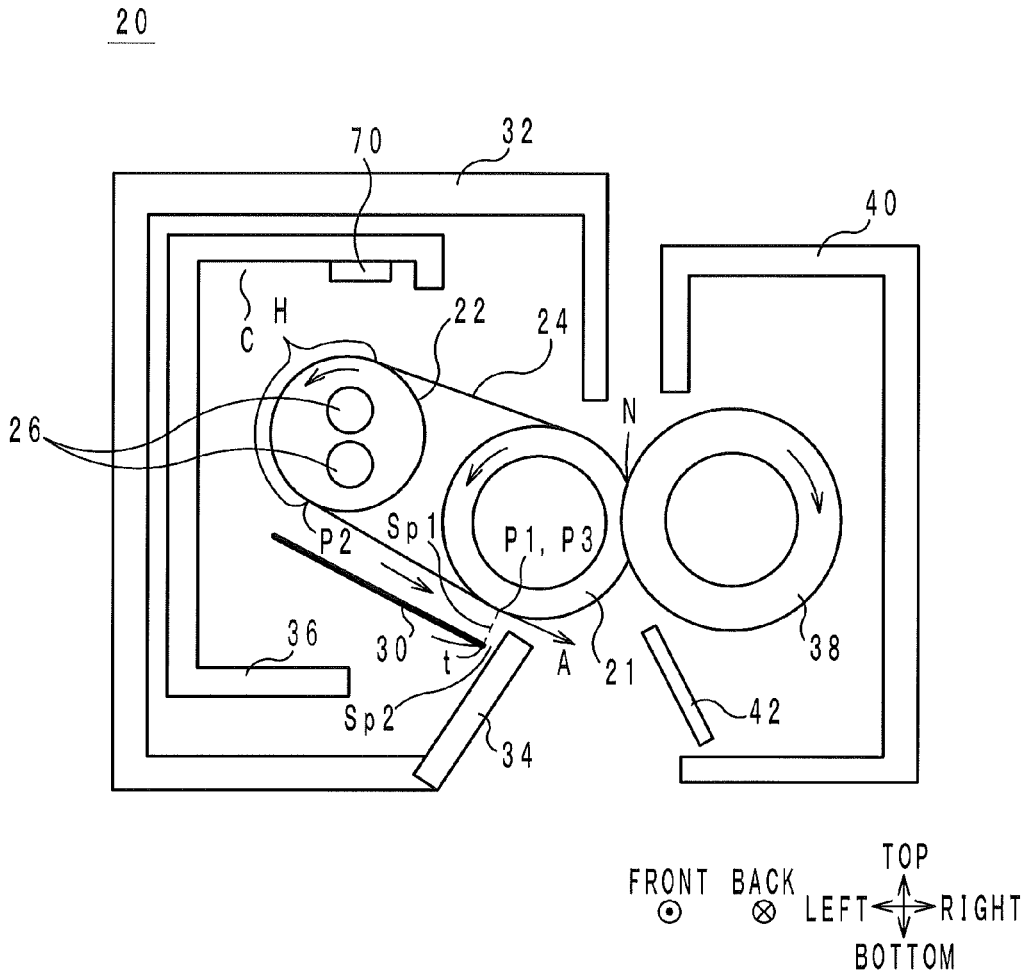
FIG. 2 is a configuration diagram of a fixing device 20.

The configuration of the fixing device 20 will be described below with reference to the drawings. FIG. 2 is a configuration diagram of the fixing device 20.

The fixing device 20 includes a fixing roller 21, a heating roller 22, a fixing belt 24, a halogen heater 26, a reflector 30, an external cover 32, a rib 34, an internal cover 36, a pressure roller 38, a cover 40, a guide 42, and a temperature sensor 70, as shown in FIG. 2.

The fixing roller 21 is a columnar member extending in the front-back direction, and is supported by bearings near the opposite ends in the front-back direction so as to be rotatable about an axis extending in the front-back direction. However, the fixing roller 21 is not a drive roller to be rotated by a drive source such as a motor, but a driven roller to be rotated by receiving an external force. The fixing roller 21 is formed, for example, by stacking a silicone rubber layer and a silicone sponge in this order, from bottom to top, around a core, which is a metallic rod. The fixing roller 21 has an outer diameter of 25 mm. The core is, for example, a solid metallic rod made with sulfur and sulfur free-machining steel (SUM24). Moreover, the silicone rubber layer and the silicone sponge are 2-mm thick. Providing the silicone rubber layer and the silicone sponge imparts elasticity to the surface of the fixing roller 21.

The heating roller 22 is a cylindrical member extending in the front-back direction, and is supported by bearings near the opposite ends in the front-back direction so as to be rotatable about an axis extending in the front-back direction. However, the heating roller 22 is not a drive roller to be rotated by a drive source such as a motor, but a driven roller to be rotated by receiving an external force. The heating roller 22 is disposed diagonally above and to the left of the fixing roller 21. The heating roller 22 has an outer diameter of mm and a thickness of 0.3 mm. Moreover, the inner circumferential surface of the heating roller 22 is painted in black. The heating roller 22 is, for example, a cylindrical metallic tube, e.g., a carbon steel tube for machine structural purposes (STKM).

The fixing belt 24 is stretched between the fixing roller 21 and the heating roller 22, and is caused to rotate, when viewed in a front view, by the rotation of the fixing roller 21 and the heating roller 22. The fixing belt 24 extends diagonally upwards to the left between the fixing roller 21 and the heating roller 22. The fixing belt 24 is formed, for example, by stacking a silicone rubber layer and a perfluoroalkoxy (PFA) resin layer in this order, from bottom to top, on a base material. The fixing belt 24 has an inner diameter of 40 mm. The base material has a thickness of 60 μm, the silicone rubber layer has a thickness of 100 μm, and the PFA resin layer has a thickness of 12 μm. Moreover, the tension in the fixing belt 24 is 50N. The tension in the fixing belt 24 is appropriately achieved, for example, by pulling the heating roller 22 in a direction away from the fixing roller 21. The fixing belt 24 is extremely thin, as described above, and therefore, can be heated to such a temperature that image fixing can be performed, in a short period of time of about 20 seconds.

The fixing belt 24 has a portion in contact with the heating roller 22, and the downstream end of the portion in the counterclockwise direction will be referred to below as "portion P2". The fixing belt 24 has another portion in contact with the fixing roller 21, and the upstream end of the portion in the counterclockwise direction will be referred to below as "portion P3". The heating roller 22 is disposed diagonally above and to the left of the fixing roller 21. Accordingly, portion P2 is located at a higher position than portion P3.

The halogen heater 26 is a heat generator provided in the heating roller 22 and extending in the front-back direction. The halogen heater 26 heats the heating roller 22. As a result, the fixing belt 24 is heated by the heating roller 22 at the portion that is in contact with the heating roller 22. The section in which the fixing belt 24 is in contact with the heating roller 22 will be referred to below as heating section H. That is, the fixing belt 24 is heated by the halogen heater 26 in heating section H. The halogen heater 26 consumes 1200 W of power, and heats an area measuring at least 300 mm in the front-back direction.

The pressure roller 38 is a columnar member extending in the front-back direction, and is supported near the opposite ends in the front-back direction so as to be rotatable about an axis extending in the front-back direction. The pressure roller 38 is provided to the right of the fixing roller 21 so as to exert pressure upon the fixing roller 21 through the fixing belt 24. That is, the pressure roller 38 contacts the fixing belt 24 on the fixing roller 21. Accordingly, there is a nip N formed between the fixing belt 24 and the pressure roller 38. The nip N is an area through which a printing medium with toner images formed thereon passes. When passing through the nip N, the toner images are situated on the (left) side of the printing medium that faces toward the fixing roller 21. Moreover, the nip N does not coincide with heating section H and is located apart from heating section H, as shown in FIG. 2. The dimension of the nip N in the top-bottom direction is 8 mm. Moreover, the pressure roller 38 presses on the fixing roller 21 at the nip N with a force of 400N.

Further, the pressure roller 38 is a drive roller to be rotated clockwise, when viewed in a front view, by a drive source such as a motor. The pressure roller 38 presses on the fixing roller 21, as described earlier. Accordingly, in the case where the pressure roller 38 is rotated clockwise when viewed in a front view, the fixing belt 24, the fixing roller 21, and the heating roller 22 are rotated counterclockwise. Note that the pressure roller 38 is rotated such that the transportation speed of the printing medium passing through the nip N is 210 mm/s.

Still further, the pressure roller 38 is formed, for example, by stacking a silicone rubber layer and a PFA resin layer in this order, from bottom to top, around a core, which is a metallic rod. The pressure roller 38 has an outer diameter of 27 mm. The core is, for example, a solid metallic rod or a carbon steel tube for machine structural purposes (STKM). Moreover, the silicone rubber layer has a thickness of 4 mm, and the PFA resin layer has a thickness of 30 μm. Providing the silicone rubber layer imparts elasticity to the surface of the pressure roller 38.

The reflector 30, when viewed in a front view, is provided around the fixing belt 24 and has a reflective surface facing the fixing belt 24. The reflector 30 reflects radiation heat of the fixing belt 24 back toward the fixing belt 24. The reflector 30, when viewed in a front view, extends at least along the portion of the fixing belt 24 that is in contact with the heating roller 22. That is, the reflector 30 extends at least along the portion of the fixing belt 24 that is to be heated. In the present embodiment, the reflector 30 faces a large part of the fixing belt 24. The upstream end of the reflector 30 in the counterclockwise direction is situated almost directly above the center of the fixing roller 21, and the downstream end of the reflector 30 in the counterclockwise direction is situated almost directly below the center of the fixing roller 21.

The reflector 30, when viewed in a front view, faces at least a part of the portion of the fixing belt 24 that is located on the downstream side in the counterclockwise direction relative to heating section H but on the upstream side in the counterclockwise direction relative to the nip N. The reflector 30 has a reflection surface on the side that faces the fixing belt 24. The reflector 30 reflects radiation heat of the fixing belt 24 back toward the fixing belt 24. In the present embodiment, the reflector 30, when viewed in a front view, is in a linear form facing a section of the fixing belt 24 that extends from portion P2 to portion P3 in the counterclockwise direction. However, the reflector 30 slightly protrudes toward the upstream side in the counterclockwise direction relative to portion P2.

Furthermore, the reflector 30 should be neither too close to nor too far away from the fixing belt 24. If the reflector 30 is too close to the fixing belt 24, excessive radiation heat of the fixing belt 24 is transmitted to the reflector 30, and if the reflector 30 is too far away from the fixing belt 24, heat is reflected insufficiently toward the fixing belt 24. When the temperature of the fixing belt 24 is within the range from 130° C. to 190° C., the distance between the reflector 30 and the fixing belt 24 is preferably from 6 mm to 8 mm.

The material of the reflector 30 preferably has low emissivity, low thermal conductivity, and low thermal capacity. However, the emissivity has higher importance than the thermal conductivity and the thermal capacity, and therefore, is prioritized for material selection. The reflector 30 may be made, for example, by subjecting a metallic material, such as aluminum, steel, or stainless steel, or a resin material, to surface treatment such as polishing or vapor deposition, or by plating such a metallic material or a resin material with aluminum. Moreover, the thickness of the reflector 30 is determined while balancing the strength of the reflector 30 and the degree of the thermal capacity to be reduced. In the case where the reflector 30 is made with a metallic material, the reflector 30 has a thickness of from 0.5 mm to 1.5 mm. In the case where the reflector 30 is made with a resin material, the reflector 30 has a thickness of from 1.5 mm to 2.5 mm.

The rib 34 is a plate-like member provided near the downstream end t of the reflector 30 in the counterclockwise direction so as to overlap with a part of gap Sp1 between the fixing belt 24 and the reflector 30. More details will be described below.

First, the closest portion of the fixing belt 24 to the end t is defined as closest portion P1. In the present embodiment, closest portion P1 coincides with portion P3. However, closest portion P1 does not have to coincide with portion P3. Moreover, the moving direction of the fixing belt 24 at closest portion P1 is defined as moving direction A. In this case, gap Sp1 lies between the end t and closest portion P1, as shown in FIG. 2. Moreover, when viewed in a plan view in moving direction A, the rib 34 overlaps with a part of gap Sp1. The part of gap Sp1 is a predetermined area from the bottom of gap Sp1 (i.e., from the end t). The top edge of the rib 34 is not in contact with the fixing belt 24, so that there is some gap therebetween. The top edge of the rib 34 is located closer than the end t of the reflector 30 to the fixing belt 24. However, if the top edge of the rib 34 is located too close to the fixing belt 24, radiation heat of the fixing belt 24 is transmitted to the rib 34. Accordingly, the clearance between the rib 34 and the fixing belt 24 is preferably, for example, from 1 mm to 5 mm. This allows the rib 34 to function as an inhibitory member for preventing air in the space between the reflector 30 and the fixing belt 24 from flowing out through gap Sp1.

Furthermore, there is gap Sp2 between the rib 34 and the end t of the reflector 30. Accordingly, a slight amount of air escapes from the space between the reflector 30 and the fixing belt 24 through gap Sp2. Here, the rib 34 is required to be close to gap Sp1 to such an extent that air in the space between the reflector 30 and the fixing belt 24 is prevented from flowing out through gap Sp1. Therefore, gap Sp2 is preferably from about 1 mm to about 3 mm.

The rib 34 extends below the fixing roller 21 diagonally upwards from left to right. Accordingly, the rib 34 functions as a guide for directing a printing medium transported from therebelow toward the nip N.

The rib 34 thus configured preferably does not transmit radiation heat of the fixing belt 24 to surrounding members. Accordingly, the rib 34 is made with a material having low thermal conductivity, e.g., resin.

The external cover 32, when viewed in a front view, partially surrounds the reflector 30 and the fixing belt 24. More specifically, the external cover 32 is a box-like member having a rectangular shape in a cross-section perpendicular to the front-back direction. Moreover, the external cover 32 accommodates the fixing roller 21, the heating roller 22, the fixing belt 24, the reflector 30, and the internal cover 36 (to be described in detail later). However, the external cover 32 is cut out both at a lower portion of the right-side surface and at a right-end portion of the bottom surface, so that the external cover 32 is open at the lower right corner. As a result, the fixing roller 21 and the portion of the fixing belt 24 that is in contact with the fixing roller 21 are exposed to the outside from the external cover 32.

The internal cover 36, when viewed in a front view, is provided between the fixing belt 24 and the external cover 32. More specifically, the internal cover 36, when viewed in a front view, is positioned so as to extend around the top, left, and bottom of the heating roller 22. Moreover, the top surface of the internal cover 36 is slightly bent downward at the right edge. In this manner, the internal cover 36 partially encloses the space above heating section H. Moreover, the space bounded by the right-side, top, and left-side surfaces of the internal cover 36 when viewed in a front view will be referred to below as heat storage C.

The temperature sensor 70 is provided in heat storage C in order to detect the temperature in heat storage C and output the detected temperature to the control unit 100. The temperature sensor 70 is a contactless temperature sensor and functions as a thermostat.

The cover 40 partially surrounds the pressure roller 38. More specifically, the cover 40 is a box-like member having a rectangular shape in a cross-section perpendicular to the front-back direction. Moreover, the cover 40 accommodates the pressure roller 38. However, the cover 40 is cut out at a portion of the left-side surface, so that the cover 40 is open at the left side. As a result, the pressure roller 38 is exposed to the outside from the cover 40.

The guide 42 extends below the pressure roller 38 diagonally upwards from right to left. Accordingly, the guide 42 directs a printing medium transported from therebelow toward the nip N.

Effects

The fixing device 20 according to the present embodiment makes it possible to further reduce heat loss. More specifically, the portion of the fixing belt 24 that has been heated in heating section H is moved to the nip N by the rotation of the fixing roller 21 and the heating roller 22. At this time, the fixing belt 24 is barely heated in the section that begins on the downstream side in the counterclockwise direction relative to heating section H and extends to the upstream side in the counterclockwise direction relative to the nip N. Accordingly, in this section, the fixing belt 24 radiates heat, and therefore, becomes cool.

Accordingly, in the fixing device 20, the reflector 30, when viewed in a front view, faces at least a part of the portion of the fixing belt 24 that is located on the downstream side in the counterclockwise direction relative to heating section H but on the upstream side in the counterclockwise direction relative to the nip N. As a result, radiation heat of the fixing belt 24 is reflected back toward the fixing belt 24 by the reflector 30. Therefore, the fixing belt 24 is inhibited from becoming cool. Thus, the fixing device 20 renders it possible to further reduce heat loss.

Note that in the present embodiment, to prevent the reflector 30 from blocking a printing medium entering the nip N, the reflector 30, when viewed in a front view, faces the fixing belt 24 in the section that spans from portion P2 to portion P3 in the counterclockwise direction. That is, the downstream end t of the reflector 30 in the counterclockwise direction is located away from the nip N.

In addition, even when the fixing belt 24 is not rotating, radiation heat of the fixing belt 24 is reflected back toward the fixing belt 24 by the reflector 30, so that the fixing belt 24 is inhibited from becoming cool.

The fixing device 20 renders it possible to reduce heat loss also for the following reasons. Specifically, in the fixing device 20, when the fixing belt 24 rotates counterclockwise, a counterclockwise air flow occurs in the space between the fixing belt 24 and the reflector 30. The air between the fixing belt 24 and the reflector 30 is warmed by radiation heat of the fixing belt 24. Accordingly, when such an air flow occurs, warmed air might escape from the space between the fixing belt 24 and the reflector 30 through gap Sp1.

Therefore, in the fixing device 20, the rib 34, when viewed in moving direction A, overlaps with a portion of gap Sp1. The rib 34 prevents warmed air from flowing out of the space between the fixing belt 24 and the reflector 30 through gap Sp1. As a result, the temperature in the space between the fixing belt 24 and the reflector 30 is inhibited from decreasing. Thus, heat loss in the fixing device 20 is reduced.

In addition, in the fixing device 20, the fixing belt 24 extends between the fixing roller 21 and the heating roller 22 diagonally upwards to the left. Accordingly, warmed air is guided diagonally upwards along the fixing belt 24. As a result, the warmed air is inhibited from flowing out of the space between the fixing belt 24 and the reflector 30 through gap Sp1. Thus, heat loss in the fixing device 20 is further reduced.

Furthermore, the fixing device 20 renders it possible to additionally reduce heat loss also for the following reasons. Specifically, the external cover 32 partially surrounds the reflector 30 and the fixing belt 24. In addition, there is gap Sp2 between the rib 34 and the downstream end t of the reflector 30 in the counterclockwise direction. Accordingly, once the fixing belt 24 starts rotating counterclockwise, some warm air in the space between the fixing belt 24 and the reflector 30 flows into the external cover 32 through gap Sp2, and remains in the external cover 32. The warm air having flowed into the external cover 32 plays the role of keeping the temperature in the external cover 32 high when the halogen heater 26 is not in operation. Thus, heat loss in the fixing device 20 is reduced.

Still further, the warm air having flowed into the external cover 32 accumulates in heat storage C inside the internal cover 36. The internal cover 36 partially encloses the space above heating section H. Accordingly, the air in heat storage C plays the role of keeping the temperature in the fixing device 20 high when the halogen heater 26 is not in operation. Accordingly, heat loss in the fixing device 20 is reduced.

The fixing device 20 renders it possible to additionally reduce heat loss also for the following reasons. The fixing belt 24 has a portion in contact with the heating roller 22, and portion P2 is located at the downstream end of the portion in the counterclockwise direction. The fixing belt 24 has another portion in contact with the fixing roller 21, and portion P3 is located at the upstream end of the portion in the counterclockwise direction. In the fixing device 20, the temperature is higher in portion P2 than in portion P3. Portion P2 is located at a higher position than portion P3. Accordingly, in the state where the fixing belt 24 is not rotating, warm air around portion P2 stays in a high position within the space between the fixing belt 24 and the reflector 30, and therefore, is prevented from flowing out of the space between the fixing belt 24 and the reflector 30 through gap Sp1. Thus, heat loss in the fixing device 20 is further reduced.

Furthermore, the reflector 30 is made with a metallic material, so that the reflector 30 can have low emissivity and high reflectivity. Thus, heat loss in the fixing device 20 can be reduced.

Still further, the reflector 30 faces only a part of the fixing belt 24, leading to easy assembly of the device.

Yet further, the temperature sensor 70 is disposed in heat storage C where high-temperature air accumulates, so that the temperature in the fixing device 20 can be detected in a short period of time.

First Modification

Figure 3:
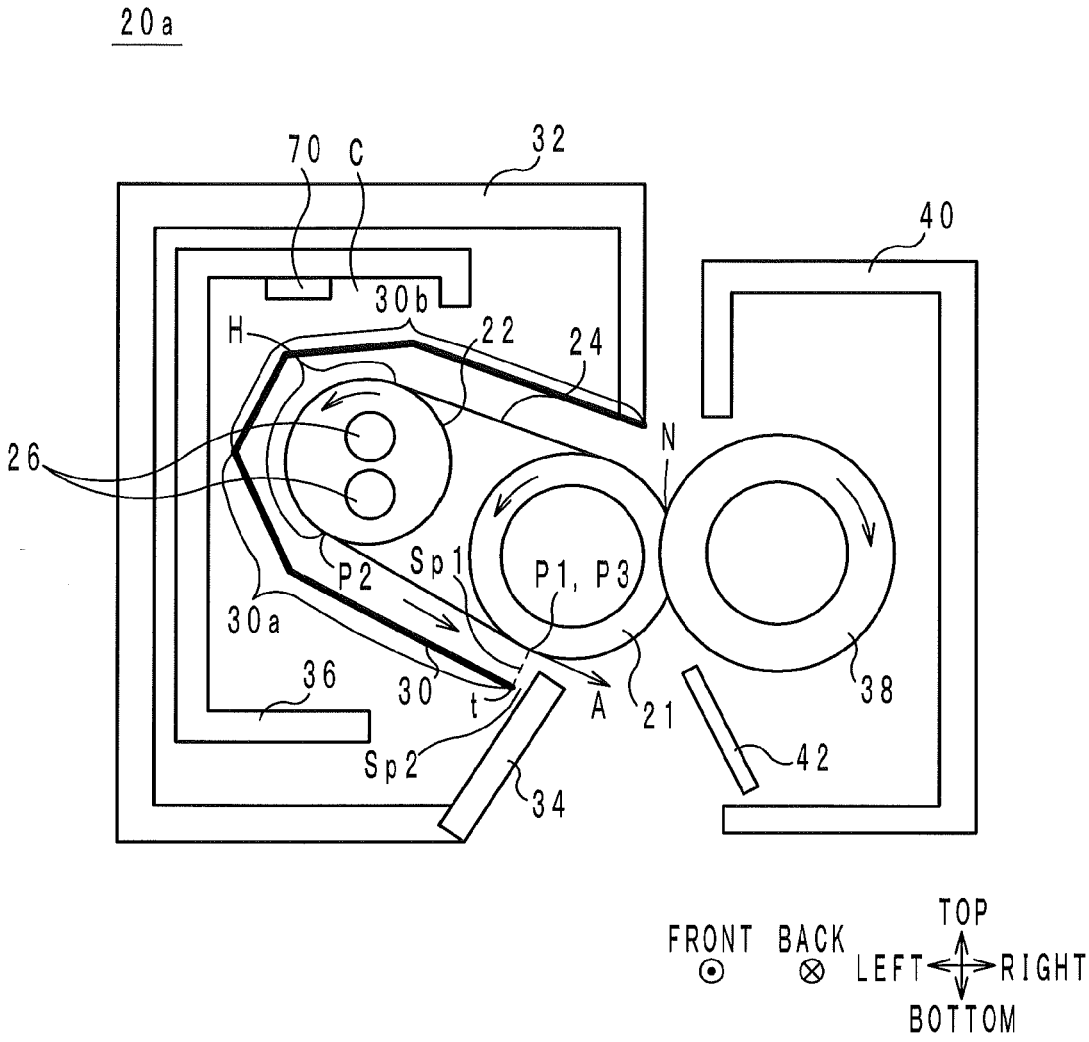
FIG. 3 is a configuration diagram of a fixing device 20*a* according to a first modification.

Hereinafter, a fixing device according to a first modification will be described with reference to the drawings. FIG. 3 is a configuration diagram of the fixing device 20*a* according to the first modification.

The fixing device 20*a* differs from the fixing device 20 in the structure of the reflector 30. The fixing device 20*a* will be described below mainly with regard to the difference.

The reflector 30 of the fixing device 20*a*, when viewed in a front view, is disposed around the fixing belt 24. More specifically, the reflector 30, when viewed in a front view, faces the fixing belt 24 in a section that spans from the upstream side to the downstream side in the counterclockwise direction relative to heating section H. Moreover, the upstream end of the reflector 30 in the counterclockwise direction is located almost directly above the center of the fixing roller 21, and the downstream end t of the reflector 30 in the counterclockwise direction is located almost directly below the center of the fixing roller 21.

Furthermore, the reflector 30, when viewed in a front view, is not curved along the fixing belt 24 but has a shape made up of straight lines bent at multiple points. Accordingly, the distance between the reflector 30 and the fixing belt 24 is not uniform. However, the reflector 30 should be neither too close to nor too far away from the fixing belt 24. When the temperature of the fixing belt 24 is within the range from 130° C. to 190° C., the distance between the reflector 30 and the fixing belt 24 is preferably from 6 mm to 8 mm.

However, the fixing belt 24 is heated by the halogen heater 26 immediately before the fixing belt 24 passes through a first section, which is located on the upstream side in the counterclockwise direction relative to the nip N and extends from the heating roller 22 to the nip N. Accordingly, the temperature of the reflector 30 tends to be relatively high in the first section. On the other hand, the fixing belt 24 becomes cool at the nip N immediately before the fixing belt 24 passes through a second section, which is located on the downstream side in the counterclockwise direction relative to the nip N and extends from the nip N to the heating roller 22. Accordingly, the temperature of the reflector 30 tends not to be relatively high in the second section. Therefore, the distance between the reflector 30 and the fixing belt 24 is set to be shorter in the second section than in the first section. For example, the distance between the reflector 30 and the fixing belt 24 in the first section is preferably from 6 mm to 8 mm. On the other hand, the distance between the reflector 30 and the fixing belt 24 in the second section is preferably from 5 mm to 7 mm.

The reflector 30 as above consists of a bottom part 30*a* and a top part 30*b*. The top part 30*b* constitutes an upper portion of the reflector 30. The bottom part 30*a* constitutes a lower portion of the reflector 30. The bottom part 30*a* and the top part 30*b* are made as individual members for the purpose of easy assembly.

The external cover 32, when viewed in a front view, is located outside the reflector 30 relative to the fixing belt 24 so as to partially surround the reflector 30 and the fixing belt 24. More specifically, the external cover 32 is a box-like member having a rectangular shape in a cross-section perpendicular to the front-back direction. However, the external cover 32 is cut out both at a lower portion of the right-side surface and at a right-end portion of the bottom surface, so that the external cover 32 is open at the lower right corner. As a result, the fixing roller 21 and the portion of the fixing belt 24 that is in contact with the fixing roller 21 are exposed to the outside from the external cover 32.

Furthermore, the upstream end of the reflector 30 in the counterclockwise direction is connected to the bottom edge of the right-side surface of the external cover 32. Moreover, the bottom edge of the rib 34 is connected to the right end of the bottom surface of the external cover 32. That is, the rib 34 is fixed to the external cover 32. Therefore, the space within the external cover 32 is not in communication with the outside of the external cover 32, except at gaps Sp1 and Sp2.

As with the fixing device 20, the fixing device 20*a* thus configured renders it possible to reduce heat loss.

The fixing device 20*a* renders it possible to reduce heat loss also for the following reasons. Specifically, the reflector 30, when viewed in a front view, is not curved along the fixing belt 24 but has a shape made up of straight lines bent at multiple points. From the viewpoint of keeping the distance between the reflector 30 and the fixing belt 24 uniform, it is preferable that the reflector 30 has a curved shape. However, by providing the reflector 30 in a shape made up of straight lines bent at multiple points, the flow of air is hindered at the bent portions when the fixing belt 24 is rotating. Accordingly, warm air tends to stay within the space between the fixing belt 24 and the reflector 30. Thus, heat loss in the fixing device 20*a* is reduced.

In the fixing device 20, the reflector 30 has a shape made up of straight lines bent at multiple points. Making the reflector 30 thus shaped by bending a metallic plate can be done more readily than making curved reflective members. Accordingly, the fixing device 20 can be produced readily. However, this does not prohibit the reflector 30 from being curved.

Furthermore, the fixing device 20 renders it possible to reduce heat loss also for the following reasons. Specifically, the fixing belt 24 is heated by the halogen heater 26 immediately before the fixing belt 24 passes through the first section, which is located on the upstream side relative to the nip N in the counterclockwise direction and extends from the heating roller 22 to the nip N. Accordingly, the temperature of the reflector 30 tends to be relatively high in the first section. On the other hand, the fixing belt 24 becomes cool at the nip N immediately before the fixing belt 24 passes through the second section, which is located on the downstream side relative to the nip N in the counterclockwise direction and extends from the nip N to the heating roller 22. Accordingly, the temperature of the reflector 30 tends not to be relatively high in the second section. Therefore, the distance from the fixing belt 24 is set to be shorter at the upstream end of the reflector 30 in the counterclockwise direction than at the downstream end of the reflector 30 in the counterclockwise direction. As a result, the reflector 30 can efficiently reflect radiation heat of the fixing belt near the downstream end of the reflector 30 in the counterclockwise direction, and also, the reflector 30 is inhibited from diffusing heat widely near the upstream end of the reflector 30 in the counterclockwise direction. Thus, heat loss in the fixing device 20*a* can be reduced.

Second Modification

Figure 4:
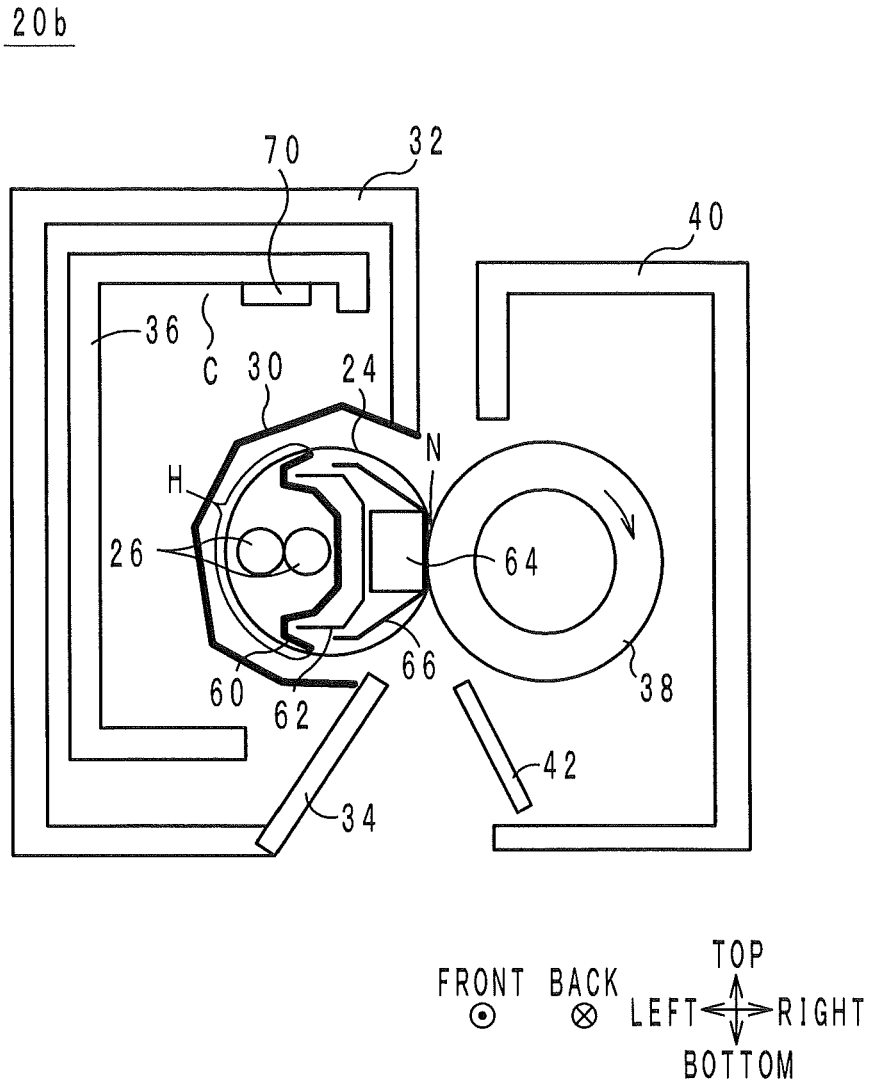
FIG. 4 is a configuration diagram of a fixing device 20*b* according to a second modification.
Figure 5:
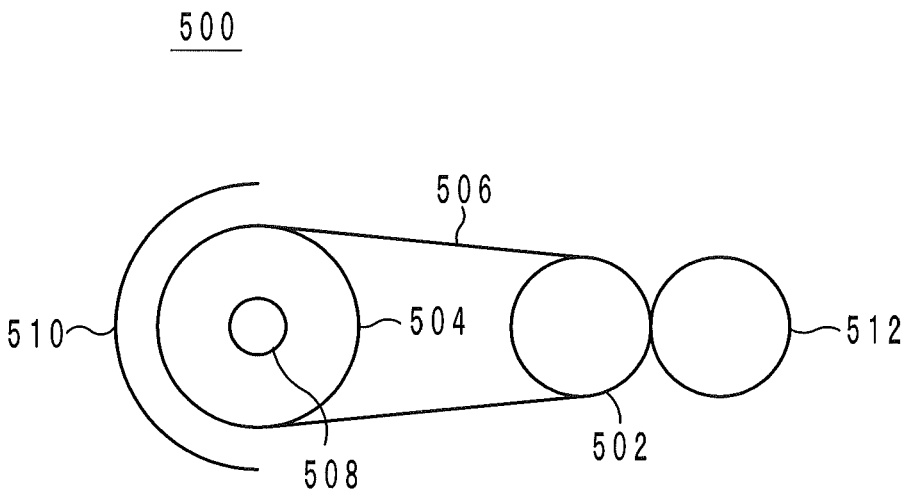
FIG. 5 is a configuration diagram of a fixing device 500 described in Japanese Patent Laid-Open Publication No. 2012-103612.

Hereinafter, a fixing device according to a second modification will be described with reference to the drawings. FIG. 4 is a configuration diagram of the fixing device 20*b* according to the second modification.

The fixing device 20*b* differs from the fixing device 20*a* in that neither the fixing roller 21 nor the heating roller 22 is provided, but a reflector 60, a support member 62, a fixing pad 64, and a sliding member 66 are provided. The fixing device 20*b* will be described below mainly with regard to the differences.

In the fixing device 20*b*, the fixing belt 24 is in the form of a cylinder extending in the front-back direction. Moreover, the halogen heater 26 is provided inside the fixing belt 24 in order to heat the fixing belt 24 directly.

The reflector 60 is located to the right of the halogen heater 26 when viewed in a front view in order to reflect radiation heat of the halogen heater 26 toward heating section H. More specifically, the reflector 60 is shaped so as to extend vertically through the center of the fixing belt 24 in the right-left direction and so as to be recessed to the right at the center in the top-bottom direction. The halogen heater 26 is disposed in the recess of the reflector 60. The left-side surface of the reflector 60 is a reflective surface facing the halogen heater 26. Accordingly, heat radiated rightward by the halogen heater 26 is reflected leftward by the reflector 60, so as to contribute to heating the fixing belt 24. Therefore, in the present embodiment, heating section H in which the fixing belt 24 is heated is positioned to the left of the reflector 60, so as to extend approximately from the top to the bottom of the reflector 60.

The support member 62 is located to the right of the reflector 60 when viewed in a front view in order to support the reflector 60. The fixing pad 64 is attached to the right-side surface of the support member 62. Moreover, the sliding member 66 is attached to the right-side surface of the fixing pad 64. In addition, the fixing pad 64 presses the sliding member 66 to the right, so that the sliding member 66 presses the inner circumferential surface of the fixing belt 24 to the right. As a result, the fixing belt 24 is in contact with the pressure roller 38 under pressure.

Furthermore, the reflector 30, when viewed in a front view, extends along the fixing belt 24. More specifically, the reflector 30, when viewed in a front view, faces the fixing belt 24 in the section that spans from the upstream side to the downstream side in the counterclockwise direction relative to heating section H. The reflector 30, when viewed in a front view, extends along approximately half of the fixing belt 24 from near the top to near the bottom.

The fixing device 20*b* thus configured can achieve the same effects as those achieved by the fixing device 20*a*.

Other Embodiments

The present invention is not limited to the fixing devices 20, 20*a*, and 20*b*, and changes can be made within the spirit and scope of the invention.

The reflector 30 and the rib 34 may be in contact with each other, but their contact area is preferably kept as small as possible. As a result, thermal conduction between the reflector 30 and the rib 34 is inhibited from occurring.

The rib 34 may be integrated with the external cover 32. This reduces the number of parts.

The fixing roller 21 may be located diagonally above the heating roller 22.

Although the present invention has been described in connection with the preferred embodiment above, it is to be noted that various changes and modifications are possible to those who are skilled in the art. Such changes and modifications are to be understood as being within the scope of the invention.

What is claimed is:

1. A fixing device, comprising:

a first rotating member rotating in a first rotational direction when viewed in a plan view in a predetermined direction;

a second rotating member contacting the first rotating member and thereby forming a nip through which a printing medium passes, wherein the second rotating member rotates in a second rotational direction opposite to the first rotational direction when viewed in a plan view in the predetermined direction;

a heating unit heating the first rotating member in a heating section not overlapping with the nip when viewed in a plan view in the predetermined direction; and a first reflective member facing at least a part of a portion of the first rotating member that is located on a downstream side in the first rotational direction relative to the heating section but on an upstream side in the first rotational direction relative to the nip, the first reflective member having a reflection surface on the side facing the first rotating member.

2. The fixing device according to claim 1, further comprising:

a first roller; and a second roller, wherein, the first rotating member is a belt stretched between the first roller and the second roller and contacting the second rotating member at the first roller, the heating unit is provided in the second roller so as to heat the second roller, and the heating section is a section in which the first rotating member is in contact with the second roller.

3. The fixing device according to claim 2, wherein the first rotating member extends diagonally upwards between the first roller and the second roller.

4. The fixing device according to claim 2, wherein the first reflective member faces the first rotating member in a section that begins at a first end located on the downstream side in the first rotational direction relative to the heating section and extends to a second end located on the upstream side in the first rotational direction relative to a portion of the first rotating member that is in contact with the first roller.

5. The fixing device according to claim 4, wherein the first end is located at a higher position than the second end.

6. The fixing device according to claim 1, wherein, the first rotating member has a cylindrical shape extending in the predetermined direction, the heating unit is disposed inside the first rotating member, and the fixing device further comprises a second reflective member provided inside the first rotating member and reflecting radiation heat of the heating unit toward the heating section.

7. The fixing device according to claim 1, wherein, the first reflective member faces a portion of the first rotating member that spans from upstream to downstream sides in the first rotational direction relative to the heating section when viewed in a plan view in the predetermined direction, and the first rotating member, when viewed in a plan view in the predetermined direction, is closer to an upstream end of the first reflective member in the first rotational direction than to a downstream end of the first reflective member in the first rotational direction.

8. The fixing device according to claim 1, further comprising a cover partially enclosing a space above the heating section and thereby creating heat storage.

9. The fixing device according to claim 8, further comprising a temperature sensing unit provided within the heat storage.

* * * * *